United States Patent [19]

Steele et al.

[11] Patent Number: 4,929,157

[45] Date of Patent: May 29, 1990

[54] PULSATION DAMPER FOR AIR CONDITIONING COMPRESSOR

[75] Inventors: Duane F. Steele, Dearborn; Eugene C. Warman, Royal Oak; Robert J. Hutter, Plymouth, all of Mich.

[73] Assignee: Ford Motor Company, Dearborn, Mich.

[21] Appl. No.: 124,196

[22] Filed: Nov. 23, 1987

[51] Int. Cl.[5] ..... F04B 39/00

[52] U.S. Cl. ..... 417/312

[58] Field of Search ..... 417/312, 313, 269

[56] References Cited

U.S. PATENT DOCUMENTS

| | | | |
|---|---|---|---|
| 3,864,801 | 2/1975 | Nakayama et al. | 29/156.4 WL |
| 4,070,136 | 1/1978 | Nakayama et al. | 417/269 |
| 4,347,046 | 8/1982 | Brucken | 417/269 |
| 4,544,332 | 10/1985 | Shibuya | 417/269 |
| 4,573,881 | 3/1986 | Romer | 417/312 |
| 4,610,604 | 9/1986 | Iwamori | 417/312 |
| 4,652,217 | 3/1987 | Shibuya | 417/312 |
| 4,768,928 | 9/1988 | Miller | 417/312 |
| 4,790,727 | 12/1988 | Steele | 417/269 |
| 4,820,133 | 4/1989 | Steele et al. | 417/269 |

FOREIGN PATENT DOCUMENTS

| | | | |
|---|---|---|---|
| 203937 | 11/1983 | German Democratic Rep. | 417/312 |

*Primary Examiner*—Leonard E. Smith

*Attorney, Agent, or Firm*—Donald J. Harrington; Frank G. McKenzie; Keith L. Zerschling

[57] ABSTRACT

A pulsation damper for a swashplate air conditioning compressor comprising a tube adapted to be inserted in the discharge port of the compressor to provide internal damping whereby the pressure pulsations are forced to travel in a reentrant flow path as the pulsations from one side of the compressor cancel or neutralize the pulsations from the other side.

4 Claims, 9 Drawing Sheets

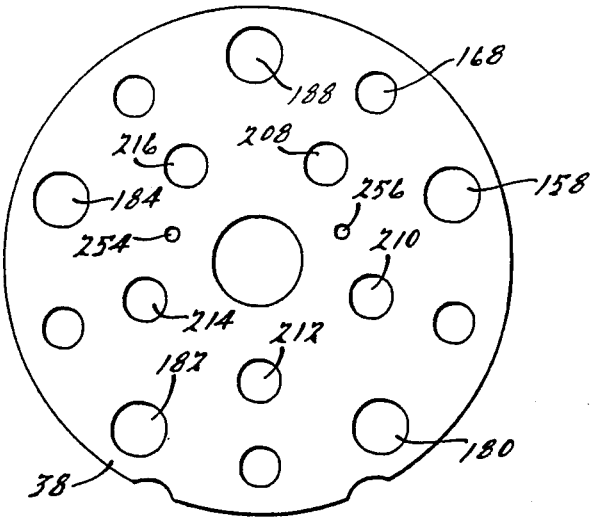
FIG. 8.
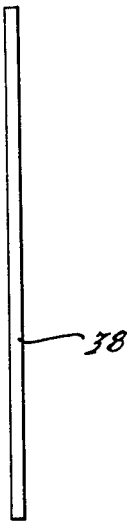
FIG. 9.
FIG. 10.
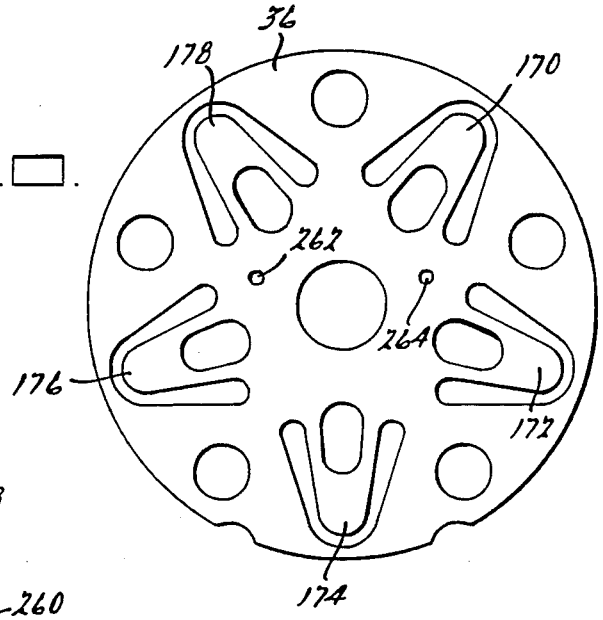
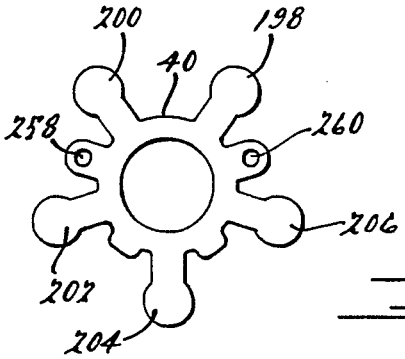
FIG. 11.

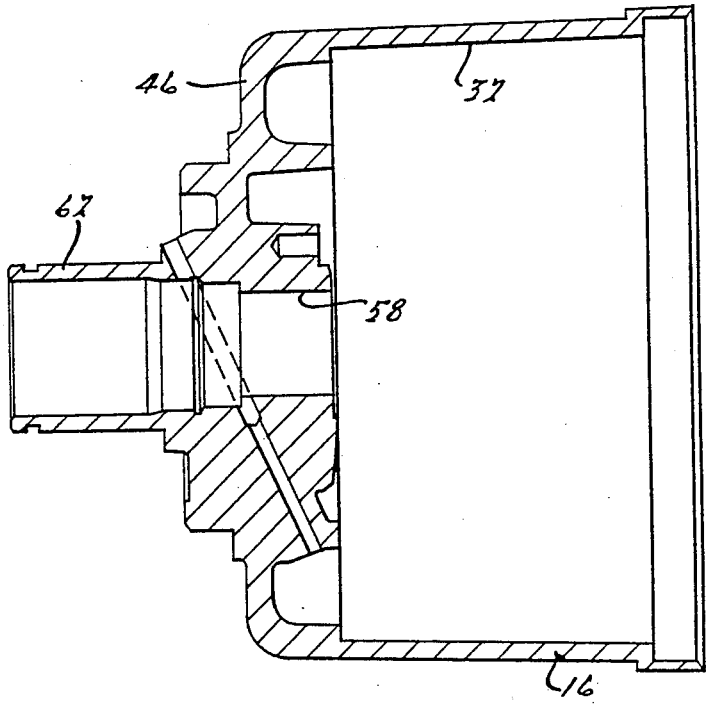
FIG. 15.
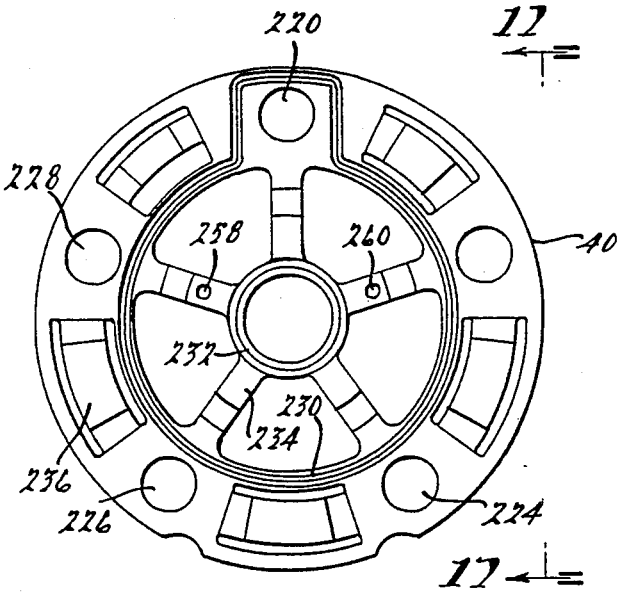
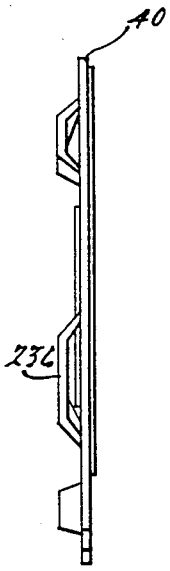
FIG. 16. FIG. 17.

PULSATION DAMPER FOR AIR CONDITIONING COMPRESSOR

BACKGROUND OF THE INVENTION

Our invention comprises an internal muffler for air conditioning compressors that is adapted to attenuate pressure pulsations. It comprises an improvement in known automotive air conditioning compressors such as those shown in U.S. Pat. Nos. 3,864,801 and 4,070,136.

Prior art compressor designs often comprise cast aluminum cylinder bodies in which are formed axially disposed cylinders, the cylinders of one cylinder body being axially aligned with respect to the cylinders of the other body. Reciprocating pistons are located within the cylinders, and the pistons are actuated by a swashplate adapted to be driven by a swashplate driveshaft.

As the swashplate rotates, the pistons, which slidably engage with swashplate, are reciprocated thereby establishing a pumping action. Compressor inlet and outlet valves are located at each axial end of the compressor assembly to accommodate the flow of low pressure refrigerant into the cylinders and the flow of high pressure refrigerant from the cylinders to a high pressure outlet. In prior art designs it is common practice, as illustrated in the patents identified above, for the housing to be formed with a crossover passage that connects each axial end of the compressor assembly with a centrally disposed discharge port, the latter extending radially with respect to the axis of the compressor. A cavity is formed in the housing parts so that the housing is capable of acting as a plenum chamber, and pressure pulsations that are developed at the flow exit sides of the cylinders for each housing portion are transferred axially toward the outlet. The pulsations of one high pressure passage generally interfere with and neutralize the pulsations acting in the other housing portion so that they tend to cancel each other.

The pulsation damping that is achieved in an arrangement of this type is unpredicable and there is no practical way of varying the length of the discharge passages through which the pulsations travel. Because of this the pulsations are perceived as an undesirable compressor noise sometime referred to as noise, vibration and harshness (NVH).

BRIEF DESCRIPTION OF THE INVENTION

Our invention comprises an improved muffler or damper which is adapted to reduce pressure pulsations that emanate from the outlet of a swashplate compressor as a result of the pumping action of high pressure refrigerant. The pulsation damper of our invention comprises a tube that is adapted to be inserted into the discharge port of an air conditioning compressor housing at one axial end of the compressor assembly. The tube acts to reduce the cross sectional area available for the refrigerant gas that is delivered by the compressor to the outlet port and to restrict the flow such that wave forms and pressure pulsations are reduced in intensity. The flow inlet of the tube is disposed within a plenum chamber in the cylinder body so that the refrigerant distributed to the outlet port must follow a re-entrant flow path. The length of the tube within the plenum chamber can be adjusted as required for any particular compressor design. The damper tube preferably is formed of a plastic molded material, and its installation and replacement becomes relatively simple.

Under certain operating conditions when so-called liquid slugging occurs, the compressor may be capable of pumping liquid refrigerant through the discharge port especially when the ambient air temperature is low. To prevent damage to the compressor because of this slugging condition, we have provided a pressure relief gate in our improved damper construction. The relief gate is designed to break and alleviate the extreme internal pressures that may be developed. If the relief gate breaks away under a slugging condition, the flow area to the pressure delivery port is increased greatly, perhaps more than double, thereby protecting the compressor from possible damage or failure. Under normal operation, however, the gate remains closed. The gate and the damper tube itself serve as a simple effective internal muffler.

Our invention eliminates the need for using a larger and heavier internal or external muffler. It also makes possible ready calibrations of the muffler to suit any particular compressor design requirement merely by permitting variations in the length of the tube or the size of the cross flow area for the tube.

BRIEF DESCRIPTION OF THE FIGURES OF THE DRAWINGS

FIG. 8 is a plan view of the front of the valve plate used in the assembly.

FIG. 9 is an edge or end view of the plate of FIG. 8.

FIG. 10 is a plan view of an inlet valve reed positioned at each axial end of the cylinder blocks.

FIG. 11 is a plan view of the outlet or discharge valve reed located at each axial end of the cylinder blocks.

FIG. 15 is a sectional view taken along the plane of section line 14A—14A of FIG. 14.

FIG. 16 is a plan view of the gasket for the discharge reed valve and valve plate at each end of the cylinder blocks.

FIG. 17 is an edge or end view of the gasket as seen from the plane of section line 16—16 of FIG. 15.

PARTICULAR DESCRIPTION OF THE INVENTION

Figure 1:
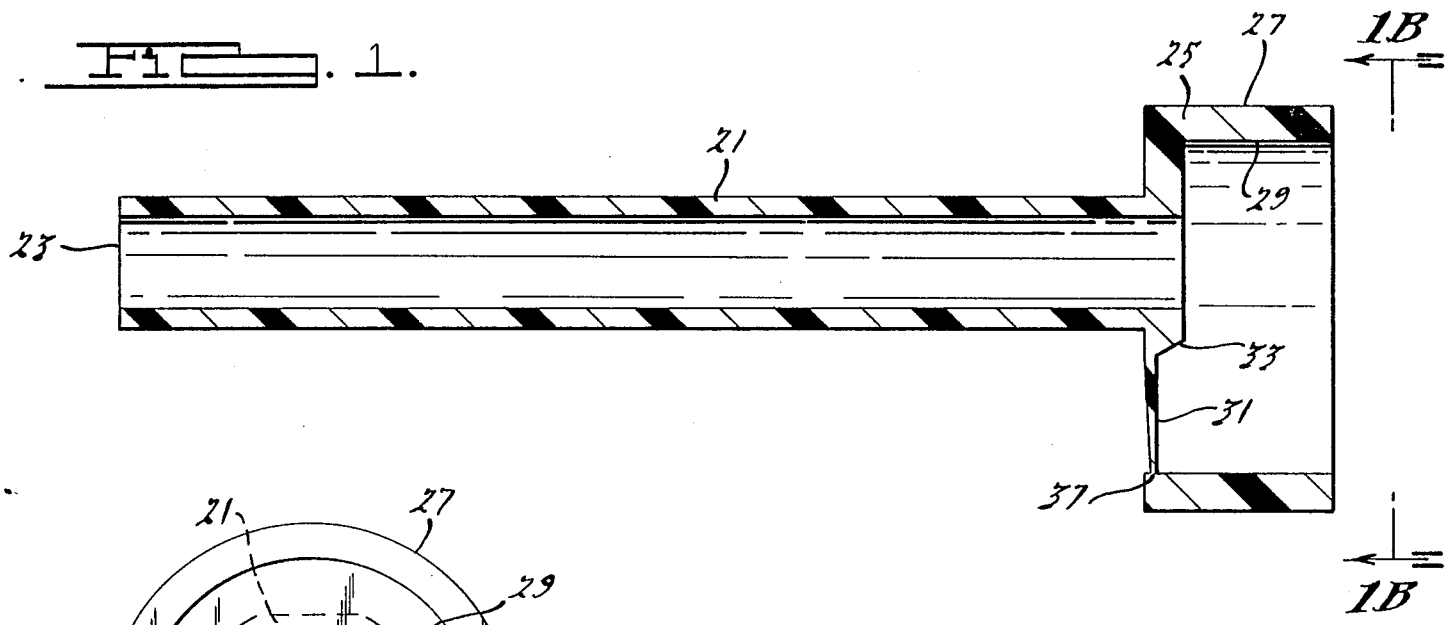
FIG. 1 shows in longitudinal, cross-sectional form a damper for use in the compressor illustrated in FIG. 1A.
Figure 1B:
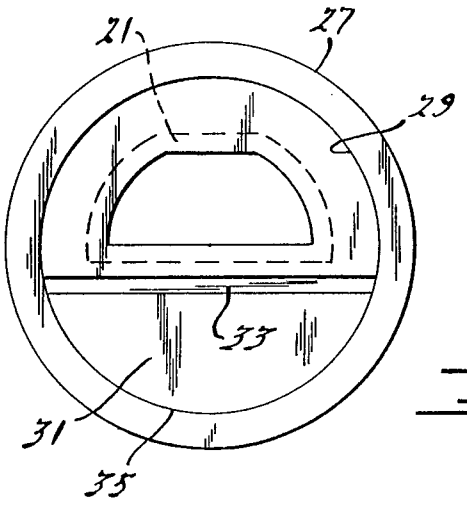
FIG. 1B is an end view as seen from the plane of section line 1B—1B of FIG. 1.

In FIG. 1 numeral 21 designates generally a damper tube preferably formed of moldable plastic material, such as a nylon resin or thermoplastic resin. The tube is formed preferably of generally semicircular cross section as seen in FIG. 1B. It is open at its left end 23. Its right end is formed inwardly with or is joined to a damper head 25 which is generally cylindrical in form. The head 24 comprises a cylindrical body 27 with a cylindrical interior 29. A valve plate 31 is formed on the tube 21 and is generally semicircular as seen in FIG. 1B. The valve plate has a straight margin 33 and a semicircular margin 35. The radially outward semicircular margin 37 of the valve plate 31 engages a registering semicircular inner surface 29 of the damper body 25. A radially inner portion of the valve plate in the region of the straight line 33 is adapted to flex if the pressure on the left hand side of the valve plate 31 exceeds a predetermined value relative to the pressure on the right hand side thereof.

The damper of FIGS. 1 and lB will be described with reference to the compressor itself, the latter being illustrated in FIGS. 1A through 17. The following is a description of the compressor which is adapted to accommodate the damper tube of FIGS. 1 and lB.

In FIG. lA reference character 10 designates generally a cast housing for the air conditioning compressor. Housing 10 includes a rear housing part 14 and a front housing part 16, each of which is formed of die cast aluminum alloy. Housing part 14 has a cylindrical interior 18 and an integral end wall 20 that forms a part of the die casting. Mounting bosses 22 and 24 are formed as part of the die casting, and mounting bolts are received in bolt openings formed in the bosses 22 and 24.

A die cast aluminum cylinder body 26, in which is formed a plurality of cylinder oPenings, is itself of cylindrical shape and is fitted within the opening 18 with a very small clearance between the inner diameter of the cylindrical opening 26 of the housing 14 and the outer diameter of the cylinder body 26.

One of the cylinder openings in the cylinder body 26 is shown at 28. A compressor piston 30 is slidably received in the cylinder opening 28.

The front compressor head comprises a companion housing part 16. Like the housing part 14, housing part 16 has a circular central opinion as seen at 32. A cylinder body 34, which itself is of cylindrical shape, is received in the cylindrical opening 32 with a minimum clearance between its outer diamter and the inside diameter of the cylindrical opening 32.

An inlet valve plate in the form of a circular spring steel disc is identified by reference numeral 36. That disc will be described with reference to FIG. 11. Adjacent the disc 36 is a front valve plate 38, which has formed in it valve openings that are registered with reed valve elements of the inlet valve disc 36. This front valve plate 38 will be described with reference to FIG. 8.

A front discharge valve plate 40, which will be described with reference to FIG. 11, is located directly adjacent valve plate 38. It is formed with reed valve elements that register with valve openings formed in valve plate 38.

A front gasket plate 42 is disposed between the front discharge valve plate 40 and the end surface 44 of the opening 32 formed in the housing part 16. Surface 44 is a machined surface on the inner face of the end wall 46 of the housing part 16.

Figure 1A:
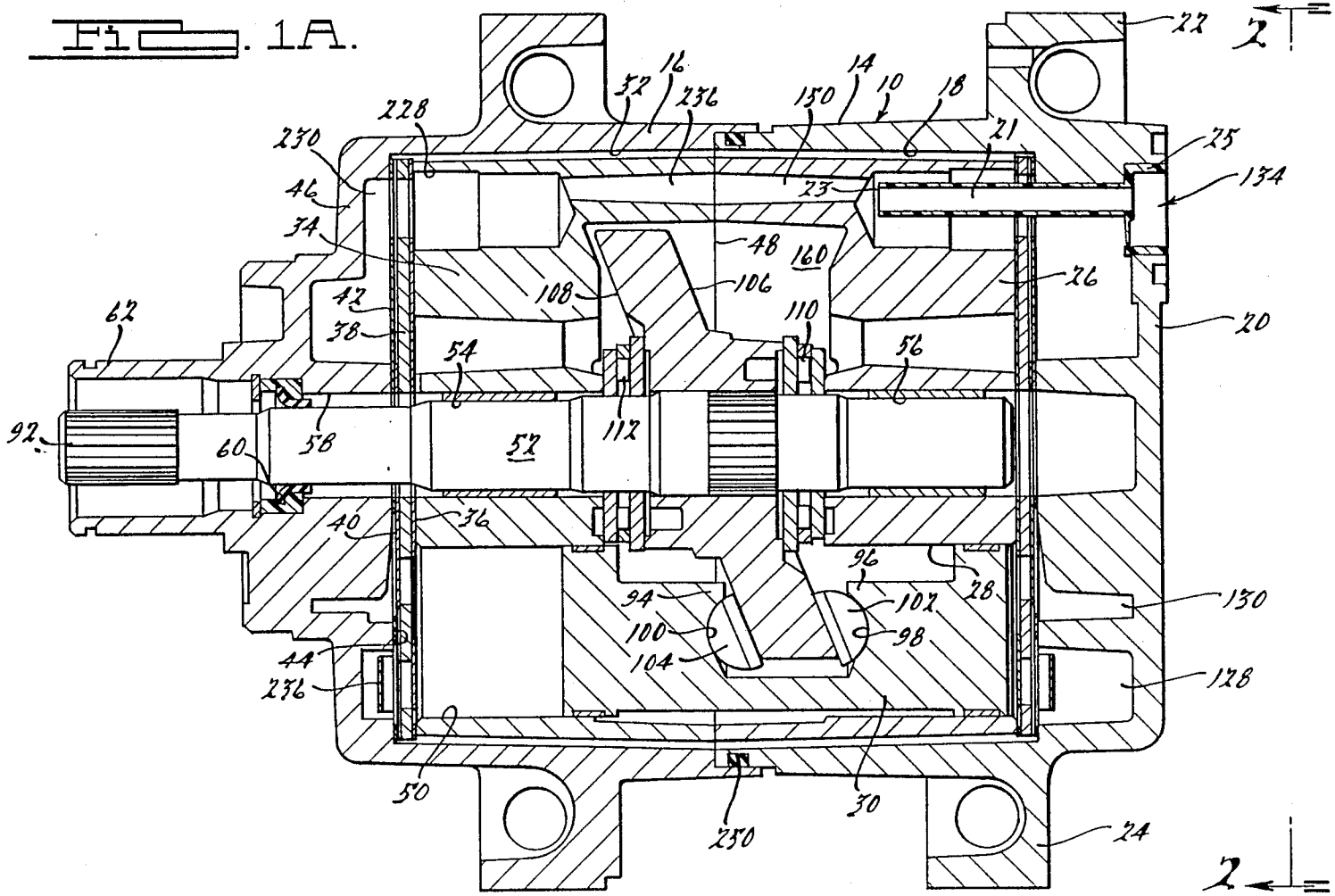
FIG. 1A is a cross-sectional view of a compressor showing the damper tube situated in the refrigerant discharge port for the compressor.
Figure 2:
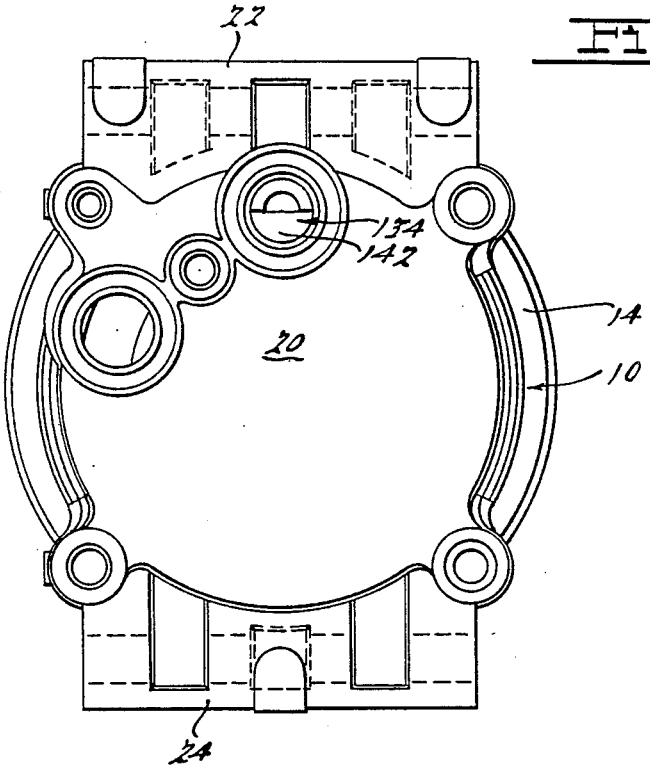
FIG. 2 is an end view of the structure of FIG. 1 as seen from the plane of section line 2—2 of FIG. 1.

As seen in FIG. 1A, the cylinder block 30 is assembled in abuting relationship with respect to the cylinder block 34, the abuting surfaces being identified by common reference numeral 48. As seen in FIG. 1A, cylinder opening 28 is aligned with cylinder opening 50 in cylinder block 34 thus forming a common cylinder for the reciprocating piston 30.

A swashplate shaft 52 is journalled by bushing 54 in cylinder block 34 and by bushing 56 in cylinder block 26. Shaft 52 extends through end plate opening 58 in the end plate 46. A fluid seal 60 seals the interior of the housing as the shaft 52 rotates in shaft opening 58.

A stationary sleeve shaft extension 62 is formed on the end plate 46 and provides a support for an electromagnetic clutch that is adapted to connect an engine driven pulley with the compressor driveshaft 52.

Figure 7:
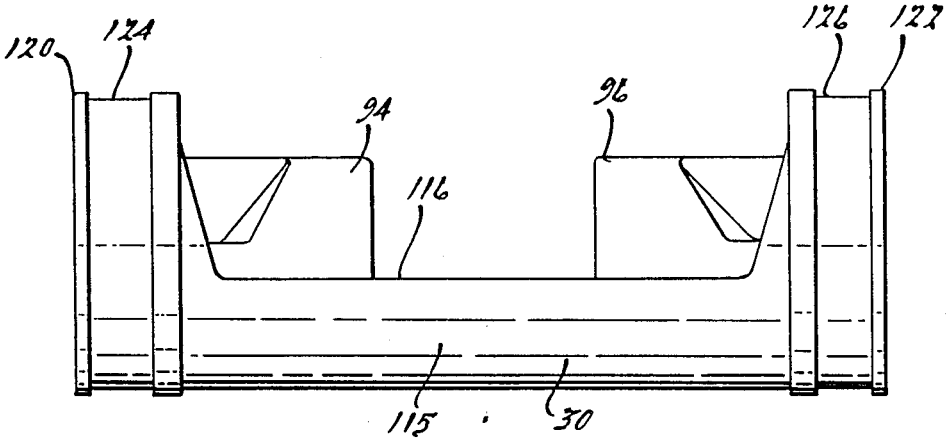
FIG. 7 is a side view of a piston adapted to be received in a cylinder of the cylinder block of FIGS. 3 and 4.

As seen in FIG. 1A and in FIG. 7, the piston comprises two juxtaposed bosses 94 and 96, which are machined to provide semi-spherical pocket recesses 98 and 100 for swashplate slippers 102 and 104, respectively. The slippers are provided with a flat bearing surface that slidably engage surfaces 106 and 108, respectively, on the swashplate and shaft assembly shown in FIG. 1A and in FIG. 5.

Figure 5:
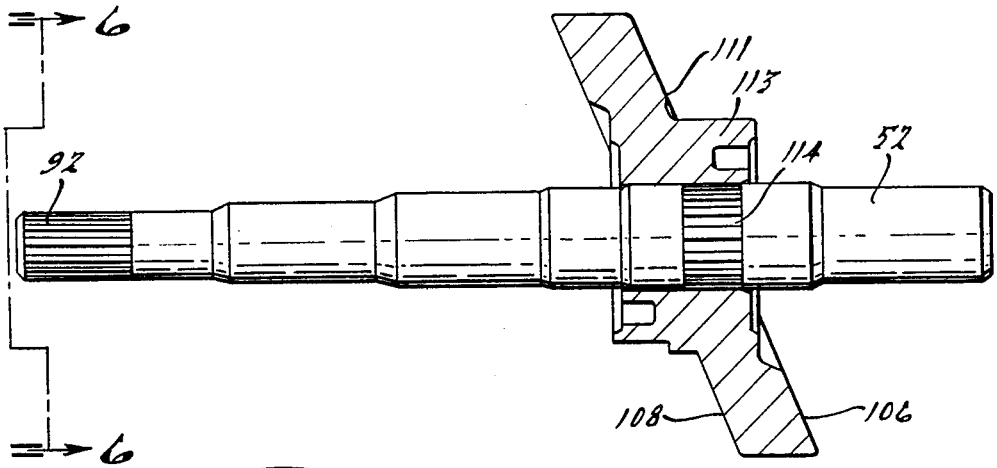
FIG. 5 is a side elevation view of a swashplate and shaft assembly which forms a part of the assembly of FIG. 1.
Figure 6:
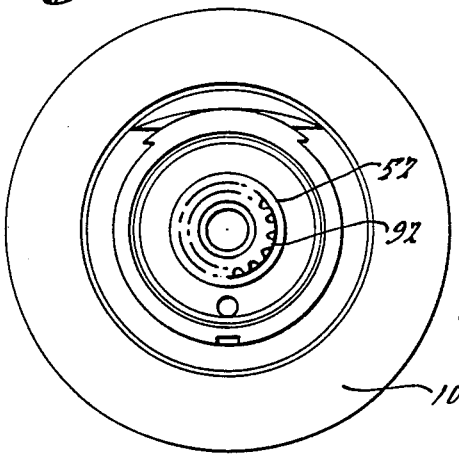
FIG. 6 is an end view of the structure of FIG. 5 as seen from the plane of section line 7—7 of FIG. 5.

The swashplate is disposed as seen best in FIG. 5, at an angle relative to the axis of the shaft. The swashplate itself, which is designated by reference character 111, includes a hub 113 that is press fitted on the shaft 52 and that is locked in place by serrations 114 formed on the shaft 52 prior to the assembly of the swashplate 111 on the shaft by the press fitting operation. As the shaft 52 rotates, the swashplate 106, due to the sliding engagement with the slippers 102 and 104, causes the piston 30 to reciprocate in the cylinder defined by cylindrical openings 28 and 50 in the cylinder blocks 26 and 34, respectively. Thrust forces on the swashplate are accommodated by the radial needle bearing assemblies 110 and 112, which respectively engage the cylinder blocks 26 and 34 whereby the thrust on the swashplate hub is absorbed by the cylinder blocks.

The slippers 102 and 104 are formed of sintered metal, and the flat bearing surfaces are porous enough to carry a lubricating oil film thus establishing a non-abrasive sliding bearing relationship with respect to the surfaces 106 and 108 as the pistons are reciprocated.

As best seen in FIG. 7, the piston 30 is formed of a unitary die casting. It includes a bridge portion 115 of reduced depth with respect to the diameter of the ends of the piston. The bridge portion is formed during the die casting operation with an upper surface 116 that is situated below the centerline of the 118 of the piston. This permits sufficient clearance for the outer margin of the swashplate 111 thereby preventing interference during operation of the compressor. This die casting operation eliminates complex machining operations that are common to reciprocating pistons of swashplate compressors of the kind illustrated in the prior art disclosures mentioned in the specification.

As seen in FIG. 7, the piston is a double acting piston and it is provided with piston ends 120 and 122 of equal diameter. Each end 120 and 122 has a piston seal groove 124 and 126 which receives a piston seal ring.

Figure 12:
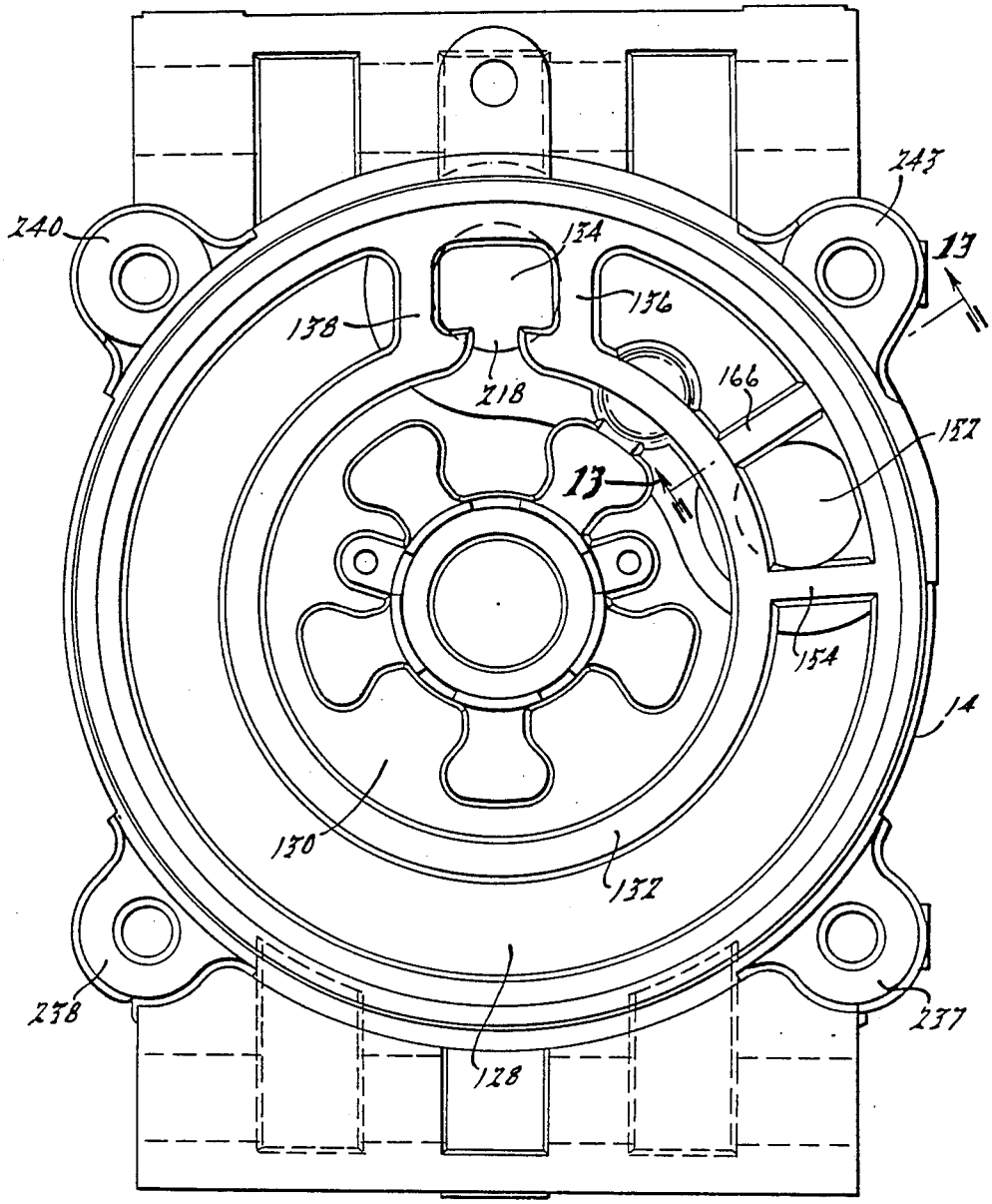
FIG. 12 is an end view of the rear casting head or housing for the assembly. It shows the interior porting and passage arrangement at the end wall of the opening in the casting head.

The rear housing part wall 20 of the housing part 14 has inlet and outlet pressure cavities that are formed in it during the die casting operation. The low pressure inlet cavity shown at 128 encircles the shaft 52 as best seen at numeral 128. It is separated from the high pressure passage 130 by a cylindrical baffle 132. The outlet port, which is a high pressure discharge port, is shown in FIGS. 1A and 12 by reference numeral 134. The upper extremity of the cylinderical baffle wall 132, as seen in FIG. 12, registers with and forms a continuation of separater walls 136 and 138 which isolate the outlet passage from the inlet passage 128. Located in the outlet opening 134 is the pulsation damper tube or muffler of FIGS. 1 and lB, preferably made of plastic material. The left hand end 23 of the tube 21, as seen in FIG. 1A, is received in discharge-e passage 150 of the rear cylinder block 26. This passage is seen best by referring to FIG. 3.

When high pressure discharge gases are distributed to the discharge port 150 of the cylinder block 26, those gases pass into the discharge passage 130 formed in the die cast end plate of the housing part 14. But before they can be transferred to the discharge opening 134 they must reverse in their directional flow toward the left hand opening of the tube 21 of the damper. The flow passage in the tube 21 is of less area than the flow area of the opening 134. This circuituous flow path for the discharge gases results in a damping of undesirable pressure pulsations in the delivery of the refrigerant.

Pressure pulsations from the left side of the compressor pass through passage 236 and interfere with pressure pulsations passing in the opposite direction from the right side of the compressor assembly. These pulsations tend to interfere, one with the other, as they enter the plenum chamber surrounding tube 21. The tube length is chosen so that maximum damping occurs. We have found that best results are achieved if the tube is approximately half the length of the passage 50 in housing port 14.

Figure 13:
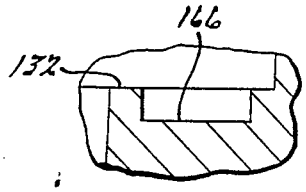
FIG. 13 is a sectional view taken along the plane of section line 13—13 of FIG. 12.

In FIG. 13 the inlet opening for the refrigerant is shown at 152. It should be noted in FIG. 12 that communication between opening 152 and the arcuate region of the inlet passage 128 is interrupted by a bridge 154. The plane of the inner surface of the bridge 154 is common to the plane of the inner surface of the baffle wall 132. Gases that enter the port 152, therefore, pass directly through openings 156 in reed valve plate 36 as see in FIG. 10.

Figure 3:
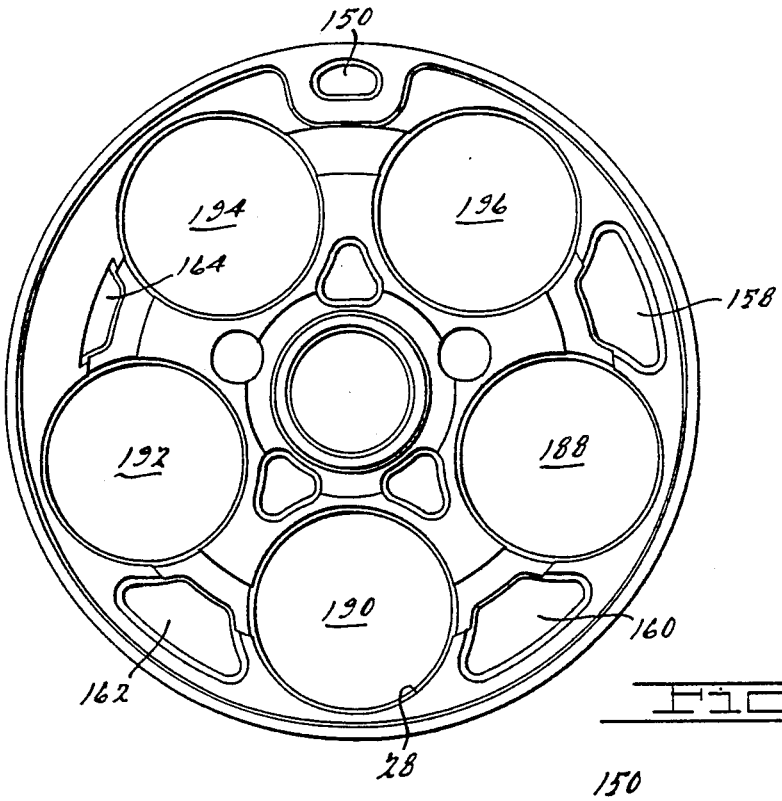
FIG. 3 is an end view of one of the two cylinder blocks that form a part of the assembly of FIG. 1.
Figure 4:
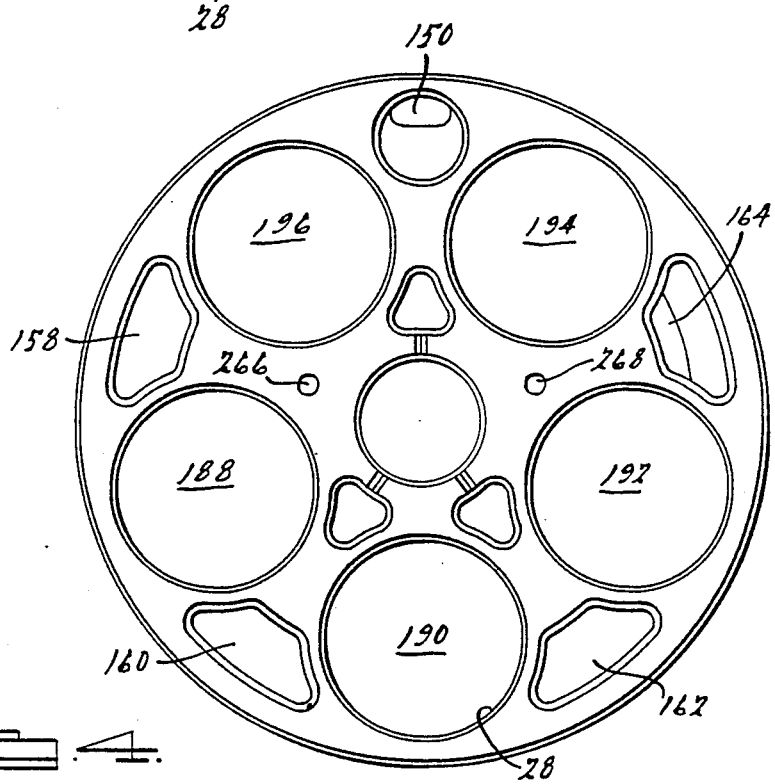
FIG. 4 is an end view showing the opposite end of the cylinder block of FIG. 4.

The low pressure refrigerant then passes through opening 158 of the rear valve plate 38 shown in FIG. 8. The refrigerant gas then is passed through openings 158 that are cast in the cylinder body 26 as seen in FIG. 3.

The gases then accumulate in the region 160. From there the refrigerant gases pass into each of the other cast low pressure passages 162 and 164 as seen in FIG. 3. The right hand end of each of these cast passages seen in FIG. 3 communicates with the low pressure passage 128 that is cast in the end wall 20 of the housing part 14, as previously described.

As seen in FIG. 13 there is a second bridge 166 which bridges the baffle wall 132 with the outer housing wall. The inner surface of this bridge 166 is lower relative to the base of the inlet passage 128 than the machined surface of the bridge 154. Thus direct communication is permitted between opening 152 and opening 168 formed in the valve plate of FIG. 8.

The valve reed disc of FIG. 10 includes a flexible cantilever valve part 170 which registers with the opening 168 and permits one-way flow through the opening 168 when the piston for the associated cylinder adjacent to it undertakes its intake stroke. The bridge 168 acts as a partial baffle that prevents transfer of a so-called slug of refrigerant in liquid form into the adjacent cylinder and permits relative equal distribution of refrigerant to each of the other cylinders. It does this by assuring that most of the refrigerant, perhaps 80 percent of the inlet flow, is transferred to the cavity 160 and distributed from there through the internal flow intake passages 162 and 164 and 158 from which it is transferred to the cast intake passage 128 formed in the end plate 20 of the housing portion 14.

As seen in FIG. 10, there are multiple cantilever valve elements at 176 and 178 as well as at 170. These valve elements or reeds register with valve plate openings 180, 182, 184, and 186 as well as with opening 158. The cylinder block 26, as seen from FIG. 4, has 5 cylinder openings which accommodate 5 compressor pistons and each cylinder is served by a separate one of the valve reeds shown in FIG. 10. As each piston 130 is stroked in a left hand direction as seen in FIG. 1, refrigerant is drawn through the valve plate opening and past its associated valve reed. Refrigerant is then drawn from the opening 128 in the case of cylinders 188, 190, 192 and 194 which are identified in FIG. 3. In the case of cylinder 196 shown in FIG. 3, refrigerant is drawn directly from the opening 152 across the bridge 168.

The discharge reed assembly of FIG. 11 includes a plurality of reed valve elements separately identified by reference characters 198, 200, 202, 204, and 206. Each of these valve elements registers with high pressure discharge openings 208, 210, 212, 214, and 216, as seen in FIG. 9. Each of these openings serves as a discharge port for the high pressure refrigerant as the pistons for the respective cylinders are stroked in a right hand direction, as seen in FIG. 1A. The discharge reeds shown in FIG. 12 permit one-way flow of high pressure gases into the discharge flow path 130 previously described with reference to FIG. 12. A baffle wall 132 is separated at 218 to permit communication between Passage 130 and the discharge passage 134.

Figure 14:
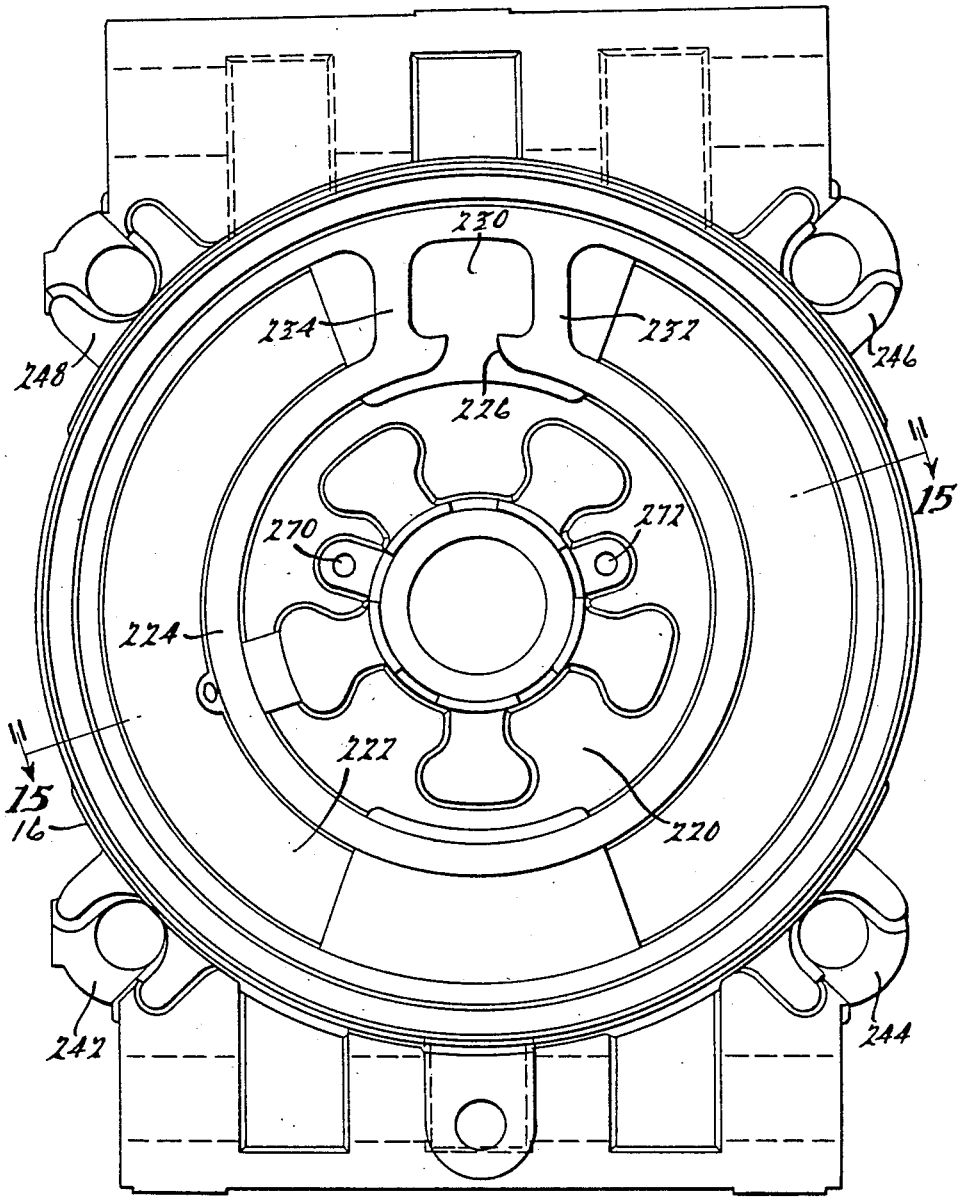
FIG. 14 is an end view of the front casting head of the housing showing the interior of the end wall of the front head together with the porting and passage structure.

The cylinder block 34 is identical and interchangeable with cylinder block 26. The valve plate, the inlet reeds and the discharge reeds described with reference to the rear housing part 14 are identical to those that function with respect to the front housing part 16. Like the rear housing part 14, the front housing part 16 shown in FIG. 14 is provided with cast high pressure and low pressure passages. The high pressure passage shown at 220 corresponds to high pressure passage 130 of the rear housing part. Low pressure passage 222 of FIG. 14 corresponds to low pressure passage 128 of the rear housing part.

A baffle wall 224, which corresponds to the baffle wall 132 of the rear housing part 14, separates passages 220 and 222. The wall 224 is discontinuous as shown at 226 to provide communication between passage 220 and the outlet opening 228 as seen in FIG. 1A. The region 230, seen in FIG. 1A and in FIG. 14, which is the high pressure region, is separated from the low pressure inlet passage 222 by bridge portions 232 and 234 of the baffle wall 224.

Fluid that is discharged by the pumping pistons passes from discharge passage 220 and into the region 230, whereupon it passes through internal crossover passage 236 seen in FIG. 1A. This passage corresponds to passage 150 that was described with reference to the rear cylinder block of FIG. 4. Passage 150 and passage 236 register at their juncture to form a continuous passage that communicates with the discharge opening 142 seen in FIG. 1A. This internal crossover passage eliminates the need for providing a separate crossover tube as in some prior art arrangements, and it may be formed during the die casting operation with minimal finish machining operations being required.

I have shown in FIG. 16 a gasket or seal plate that is interposed between the valve plate and the inner machined surface of the front and rear housing parts. The gasket of FIG. 14, which was described with reference to FIG. 1A and identified by reference numeral 140, includes an opening 220 with a high pressure opening 186 in the valve plate of FIG. 8. It includes also openings 222, 224, 226, and 228 which register with cast end openings in the front cylinder block, which in turn correspond to the cast end openings previously described with reference to the cylinder block 26 shown in FIG. 3. These respectively are shown at 150, 158, 160, 162 and 164.

FIG. 16 shows at 230 an embossment which encircles the axis of the shaft 52 and which envelopes the opening 220. The embossment forms a continuous ridge directly adjacent the machined inner surface of the baffle wall 224, as shown in FIG. 14. It registers also with the machined surface of the bridge portions 232 and 234 of the baffle wall 224. Thus the embossment forms an effective seal that isolates the high pressure cast passage 220 from the low pressure cast passage 222. The gasket or seal of FIG. 16 includes also an inner embossment ring 232 which prevents passage of high pressure refrigerant from the high pressure discharge port for the cylinders from the region of the bearing 54 and the shaft opening 58.

A similar gasket or seal plate is used to seal the high pressure and low pressure passages in the end plate 20 of the rear housing part 14.

The valve plate for the front cylinder block is identical to the valve plate for the rear cylinder block. Similarly, the inlet valve reeds and the discharge valve reeds for the front and rear cylinder blocks are identical, one with respect to the other. This interchangeability, as well as the interchangeability of the cylinder blocks themselves, simplifies both the design and the manufacture and assembly of the components, thus making it possible to achieve reduced manufacturing costs and improved reliability during operation following assembly.

Radial arms, one of which is shown at 234 in FIG. 16, support the hub of the gasket on which the embossment 232 is formed.

Near the radially outer margin of the gasket of FIG. 16 are straps 236 which provide rigidity to the disc but which are displaced out of the plane of the gasket thereby permitting free flow of refrigerant gas through the valve plate openings and past the inlet valve reeds. The relative position of the straps 236 with respect to the plane of the gasket can be seen by referring to FIG. 1 where the gasket is shown in cross section.

As seen in FIG. 12 the rear housing part 14 has four external bosses 237, 238, 240, and 242. Similarly, the front housing part 16 has bosses 243, 244, 246 and 248, which register with the bosses 237, 238, 240, and 242 of the front housing part 16. Each of these bosses has a bolt opening to permit entry of a clamping bolt. When the bolts are tightened following assembly of the components, the cylinder blocks are brought into registry, one with respect to the other, and a predetermined load is applied to the gasket. Effective seals thus are established. The left hand margin of the housing part 14 is received within the right hand margin of the housing part 16, as seen in FIG. 1A, and an "O" ring seal 250, which is received in an "O" ring groove in the housing part 14, establishes a fluid tight seal between the mating parts.

The previously mentioned slipper shoes that engage the surfaces 106 and 108 of the swashplate are formed of powdered metal that may be heat treated to a hardness of over 40 Rockwell C. It is possible, therefore, to eliminate the necessity for using a separate shoe on the movable slipper element as in prior art designs such as those shown in the prior art references mentioned in the preceding portion of this specification. Only the slide bearing surfaces need be finished by grinding or by lapping. The shoes themselves may or may not be tumbled after they are finished. In addition to the interchangeability of the parts — for example, the inlet valve disc, the discharge valve disc and the valve plate — preassembly of the valve plate with the gasket and the two reed valve discs can be achieved by locater pins which are received in pin openings formed in valve plate 38 illustrated in FIG. 8. These pins are received with a force fit in pin openings 254 and 256 as seen in FIG. 8. Corresponding openings 258 and 260 are formed in the discharge valve of FIG. 11, and these register with the locater pins. Similarly, locater pin openings 258 and 260 are formed in the gasket as formed in FIG. 16, and these also register with the locater pins.

On the opposite side of the valve plate pin openings 262 and 264, as seen in FIG. 10, register with the valve pins. Thus the valve plate, the inlet valve disc, the discharge valve disc, and the gasket can be preassembled to simplify the manufacturing operation. After this preassembly procedure the subassembly is inserted into registering pin locater openings 266 and 268, shoWn in FIG. 4 for the rear housing part. Corresponding pin openings 270 and 272 for the front housing part can be seen in FIG. 14. These locater pins establish proper angular registery of the assembled parts, one with respect to the other. No fasteners are required and the manufacturing cost and assembly cost and improved reliability by a simplified assembly is achieved.

Manufacturing operations are simplified further by the piston construction as explained previously. The piston construction has a bridge area that does not require finished machining. The bridge area is formed during the die casting operation and it permits the swashplate outside diameter at maximum displacement to extend beyond the bosses for the slippers. There is no need for machining a relief area in the bridge surface as in the prior art constructions, examples of which are shown in the references described in this specification. It is permissible with this design for the swashplate to engage the bridge surface with a running engagement on the midpoint surfaces of the bridge.

The improved design further provides improved reliability and simplified manufacturing operations by reason of the die casting process for forming the swashplate itself. It is normal practice in the design of a swashplate compressor to use a cast forge process or by using a forging process without casting. The depth between the face of the shoe and the hub of the swashplate is sufficiently reduced in our design to assure sufficient strength. The presence of the refrigerant in the region of the swashplate provides sufficient lubrication because sufficient lubricating oil is present. Then the refrigerant gas permits an oil film to be developed continuously over which the slippers may act.

The bearings 54 and 56 for the shaft 52 are steel backed sleeve bearings which can be assembled with no further machining being required after installation. These are located, as seen in FIG. 1A, adjacent radial needle bearings 112 and 110 respectively. The cage for the radial rollers of the bearings 112 and 110 rotate in the usual fashion between two thrust washer rings. This establishes a centrifugal pumping action which draws lubricant and refrigerant from the inboard ends of the sleeve bearings. A pressure differential exists between the swashplate chamber and the inlet annulus that is cast in each of the end plates for the housing parts. The existence of this pressure differential creates a pressure differential across the bearings themselves and this is aided by the centrifugal action of the rotating cages of the radial needle bearings, which act as thrust bearings. Thus the cages of the radial needle bearings, which act as thrust bearings, and the journal bearings are lubricated thereby further improving the reliability of the compressor.

Having described a preferred embodiment of our invention, what we claim and desire to secure by U.S. Letters Patents is:

1. In a swashplate air conditioning compressor having a rotary swashplate and axially movable pistons located in cylinder bodies, said compressor having a refrigerant flow discharge port structure at one axial end of said compressor;

a damper comprising a damper tube of a calibrated length having a cross-sectional area less than the cross-sectional area of said port; and a plenum chamber in one of said cylinder bodies surrounding said tube which communicates with the discharge sides of said cylinders;

said tube having an open flow intake end located within said plenum chamber whereby refrigerant flow follows a reentrant flow path and the pressure pulsations due to the pumping action of said cylinders tend to cancel each other thus reducing noise, vibration and harshness of said compressor.

2. The combination as set forth in claim 1 wherein said tube is approximately half the cross-sectional area of said port, said tube being generally in alignment with the discharge passage in the associated cylinder body.

3. In a swashplate air conditioning compressor having a rotary swashplate and axially movable pistons located in cylinder bodies, said compressor having a refrigerant flow discharge port structure at one axial end of said compressor;

a damper comprising a damper tube of a calibrated length having a cross-sectional area less than the cross-sectional area of said port; and a plenum chamber in one of said cylinder bodies surrounding said tube which communicates with the discharge sides of said cylinders;

said tube having an open flow intake end located within said plenum chamber whereby pressure pulsations due to the pumping action of said cylinders tend to cancel each other thus reducing noise, vibration and harshness of said compressor;

said damper comprising a damper body received in said discharge port, the cross-sectional area of said damper body being greater than the cross-sectional area of said tube, and a valve plate forming a part of said damper body and situated in said port whereby one side thereof is exposed to refrigerant pressure in said plenum chamber, said valve plate being adapted to flex and to open communication between said plenum chamber and said discharge port when refrigerant pressure exceeds a desired value.

4. The combination as set forth in claim 3 wherein said tube is approximately half the cross-sectional area of said port, said tube being generally in alignment with the discharge passage in the associated cylinder body.

* * * * *

UNITED STATES PATENT AND TRADEMARK OFFICE

CERTIFICATE OF CORRECTION

PATENT NO. : 4,929,157

DATED : May 29, 1990

INVENTOR(S) : Duane F. Steele, et al

It is certified that error appears in the above-identified patent and that said Letters Patent is hereby corrected as shown below:

Column 3, line 43, "oPenings" should be --openings--.
Column 3, line 53, "opinion" should be --opening--.
Column 4, line 59, "of the 118" should be deleted.
Column 5, line 18, "discharge-e" should be --discharge--.
Column 5, line 49, "see" should be --seen--.
Column 6, line 44, "Passage" should be --passage--.
Column 8, line 40, "shoWn" should be --shown--.

Signed and Sealed this

Twenty-fourth Day of September, 1991

*Attest:*

HARRY F. MANBECK, JR.

*Attesting Officer*

*Commissioner of Patents and Trademarks*